United States Patent [19]

Sakurada et al.

[11] 4,296,965

[45] Oct. 27, 1981

[54] SEAT WITH ADJUSTABLE LUMBAR SUPPORTER

[75] Inventors: Kenichi Sakurada, Yokohama; Takaichi Nishino, Hachioji, both of Japan

[73] Assignees: Nissan Motor Company, Limited, Yokohama; Tachikawa Spring Company, Limited, Akishima, both of Japan

[21] Appl. No.: 56,607

[22] Filed: Jul. 11, 1979

[30] Foreign Application Priority Data

Jul. 31, 1978 [JP] Japan ..... 53-93776

[51] Int. Cl.[3] ..... A47C 7/46

[52] U.S. Cl. ..... 297/284

[58] Field of Search ..... 297/284; 267/89

[56] References Cited

U.S. PATENT DOCUMENTS 3,762,769 10/1973 Poschl ..... 297/284
3,948,558 4/1976 Obermeier ..... 297/284
3,973,797 8/1976 Obermeier ..... 297/284
4,148,522 4/1979 Sakurada ..... 297/284
4,159,847 7/1979 Arai ..... 297/284

FOREIGN PATENT DOCUMENTS 2343712 5/1974 Fed. Rep. of Germany ..... 297/284

*Primary Examiner*—Francis K. Zugel

[57] ABSTRACT

A backrest of a seat has therein an adjustable lumbar supporter which comprises a first rod member transversely crossing two side brackets of the backrest to be rotatable about the axis thereof, an arm member secured at one end to the first rod member, a second rod member rotatably supported by the arm member, a lumbar supporter proper fixed to the second rod member, a first control mechanism for forcing the lumbar supporter proper to swing about the axis of the first rod member when operated, and a second control mechanism for forcing the lumbar supporter proper to swing about the axis of the second rod member when operated.

8 Claims, 7 Drawing Figures

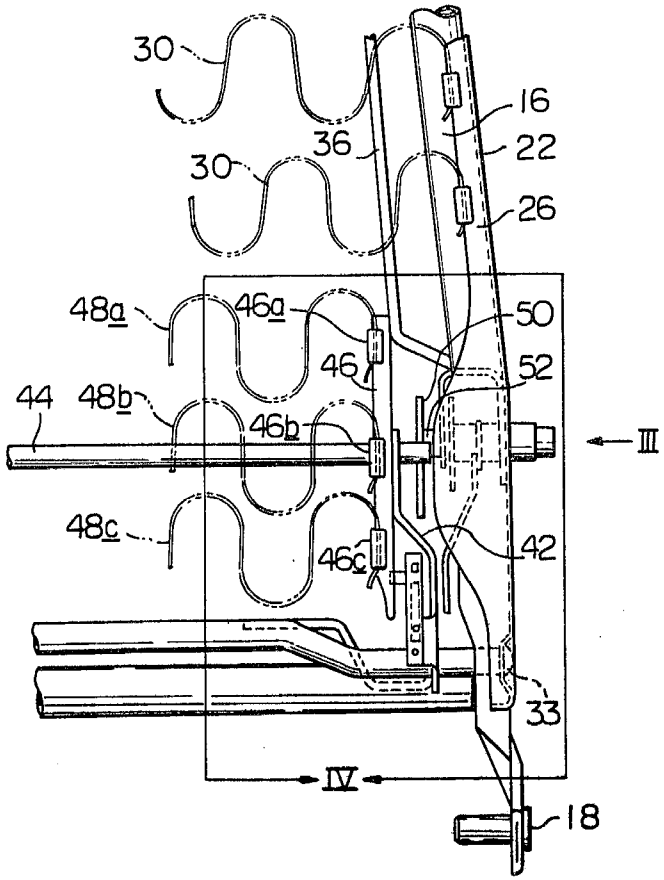
Fig. 2
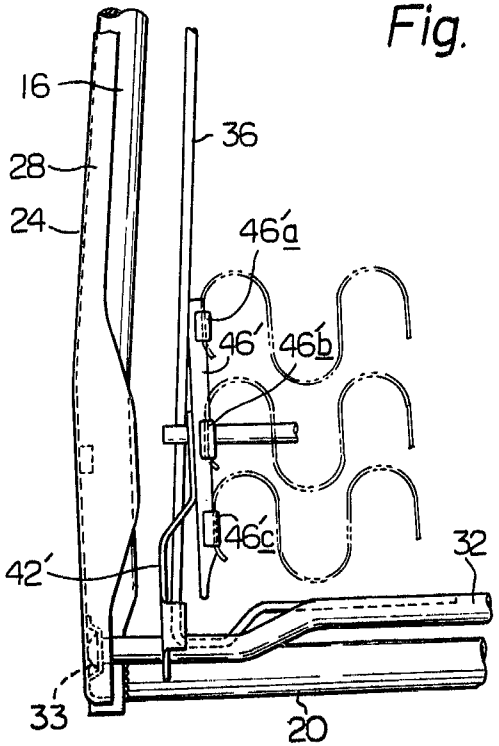

SEAT WITH ADJUSTABLE LUMBAR SUPPORTER

FIELD OF THE INVENTION

The present invention relates in general to a seat and more particularly to a vehicle seat having a backrest whose contour is adjustable to conform to the lumbar contour of a particular occupant in a vehicle.

BACKGROUND OF THE INVENTION

For increasing riding comfort and for minimum occupant fatigue, a vehicle seat backrest must support the lumbar area of the seat occupant's back. But it is recognized, that the construction of universally satisfactory permanent backrest structures can not be effected because of differences in individual body sizes and proportions.

In view of the above, it has become popular to equip a vehicle seat with a so-called "adjustable lumbar supporter" held in the backrest of the seat. However, such an adjustable lumbar supporter conventionally used still has a limitation in setting a plurality of positions. In fact, the adjustment of the supporter is limited to either forward-rearward positioning or upward-downward positioning. More specifically, the positioning of the lumbar supporter is made by moving it monodirectionally. Thus, the most desired and effective positioning of the supporter for properly supporting the lumbar area of the seated occupant has not been obtained.

OBJECTS OF THE INVENTION

Therefore, it is an object of the present invention to provide a seat which is equipped at the backrest thereof with an improved adjustable lumbar supporter which can assume the most desired and effective position for properly supporting the lumbar area of the seated occupant.

It is another object of the present invention to provide an improved adjustable lumbar supporter which is adjustable in both fore-and-aft direction and upward-and-downward directions for supporting the seated occupant's lumbar area irrespective of differences in individual body sizes and proportions.

It is still another object of the present invention to provide an improved lumbar supporter which is easily operated.

According to the present invention, there is provided a seat with a backrest having spaced support portions by which a contourable portion constituted by padding means is supported, and an adjustable lumbar supporter for imparting a curvature to the contourable portion to produce a desired contour, the lumbar supporter compriing a first rod member transversely crossing the support portions in a manner to be rotatable about the axis thereof relative to the support members, an arm member secured at its one portion to the first rod member to be rotatable therewith, a second rod member held by the arm member in a manner to be rotatable about the axis thereof relative to the arm member, lumbar pressing means fixedly mounted on the second rod member, first control mechanism for forcing a unit of the arm member, the second rod member and the lumbar pressing means to swing about the axis of the first rod member when operated, and a second control mechanism for forcing a unit of the lumbar pressing means and the second rod member to swing about the axis of the second rod member relative to the arm member when operated.

BRIEF DESCRIPTION OF THE DRAWINGS

Other objects and advantages of the present invention will become clear from the following description when taken in conjunction with the accompanying drawings, in which:

FIG. 2 is an enlarged partial view taken on the line II—II of FIG. 1;

DESCRIPTION OF THE PREFERRED EMBODIMENT

Through the specification, the terms "forward" and "rearward" are to be understood as referring to "in the direction to the front of the subject seat" and "in the direction to the rear of the subject seat", respectively and "upward" and "downward" to be taken as upward and downward with respect to the subject seat, respectively.

Figure 1:
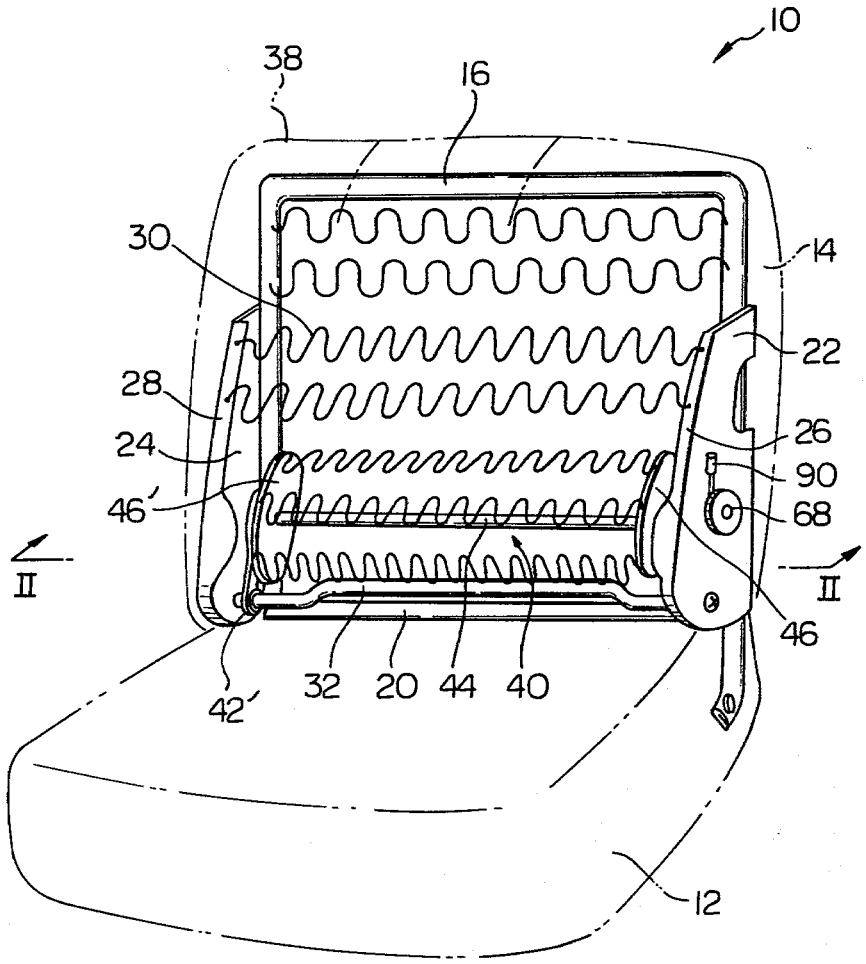
FIG. 1 is a perspective partially broken view of a seat according to the present invention.
Figure 3:
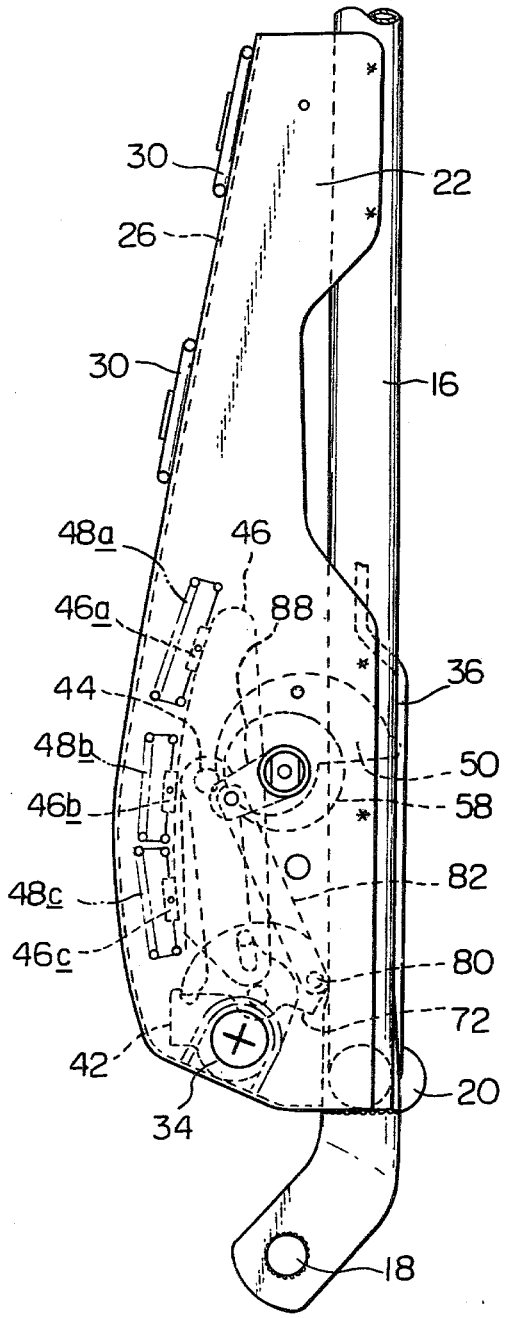
FIG. 3 is a view taken from the direction of arrow III of FIG. 2.
Figure 7:
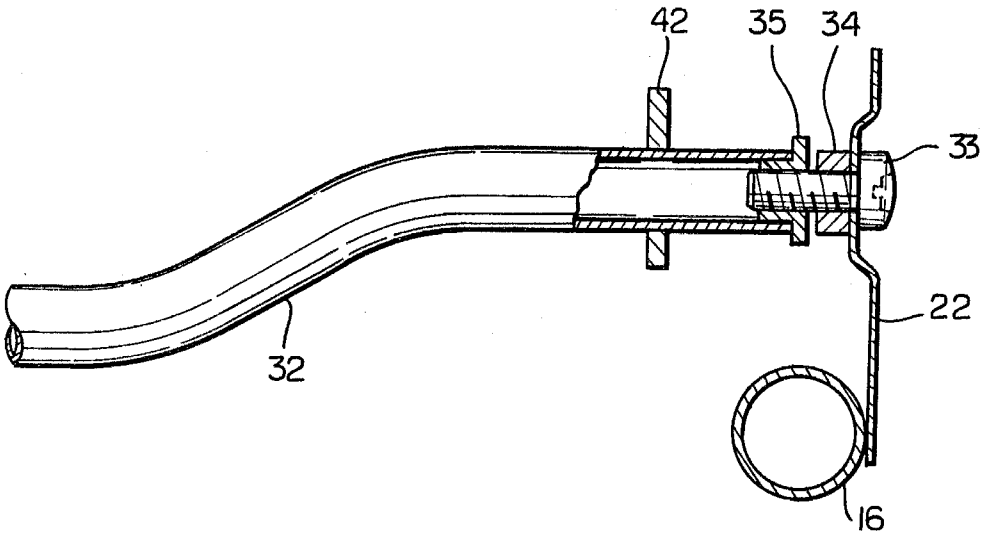
FIG. 7 is a partially sectional view taken along the line VII—VII of FIG. 4.

Referring to the drawings, particularly FIG. 1, there is illustrated a seat according to the present invention, which is generally designated by numeral 10. The seat 10 comprises a seat cushion 12 mounted via suitable supporting means on the floor (not shown) of a vehicle, and a backrest 14 pivotally supported on a rear section of the cushion 12 in a manner as will be understood hereinnext. The backrest 14 comprises an arch-shaped tubular frame 16 having spaced support portions or foot portions (no numerals) one (right side one) of which is somewhat extended and is pivotally connected via a pin 18 to the rear section of the seat cushion 12 thereby to achieve tiltable connection of the backrest 14 relative to the seat cushion 12. A tubular lower frame 20 is spanned between leg sections of the frame 16 to form a rectangular frame construction. Side brackets 22 and 24 are secured via welding to the leg sections of the tubular frame 16 permitting each longitudinal edge thereof to evenly project forwardly as is best seen from FIG. 3. The respective front edges of the side brackets 22 and 24 are formed with flanges 26 and 28 extending toward each other. Spanned between the side brackets 22 and 24, particularly between the flanges 26 and 28 are alternately curved spring wires 30 which are parallel with each other. A lower rod 32 having an eccentric middle section (no numeral) is spanned via pivot pins 33 between lower sections of the side brackets 22 and 24 in a manner to be rotatable about an axis passing through the pins 33. Nuts 34 and nut collars 35 are used for the pivotal connection between the lower rod 32 and the pins 33 (see FIGS. 4 and 7). Denoted by numeral 36 (see FIG. 2) is a generally rectangularly formed spring wire which is fixedly but partially connected via welding to the tubular frame 16 and the lower rod 32. These elements such as the tubular frame 16, side brackets 22 and 24, springs 30, and spring wires 36 are wrapped by conventional padding means which is illustrated by a phantom line 38 in FIG. 1. Within the backrest 14 is disposed an adjustable lumbar supporter which consists of an important part of the present invention and is generally designated by numeral 40 in FIG. 1.

Description of the adjustable lumbar supporter 40 will be commenced with respect to a lumbar holding section by the aid of FIG. 2.

As will be understood from FIG. 2, the lumbar holding section of the adjustable lumbar supporter 40 is located in the lower part of the backrest 14 and comprises two spaced arms 42 and 42' which are fixed at their lower ends to the lower rod 32 to be rotatable therewith about the pivot pins 33. The arms 42 and 42' have at the upper sections thereof respective openings (no numerals) through which an upper rod 44 passes to be rotatably supported by the arms 42 and 42'. Two spring holders 46 and 46' each having at the front edge thereof three hook portions 46*a*, 46*b* and 46*c* or 46'*a*, 46'*b* and 46'*c* are firmly mounted at the generally middle sections thereof on the upper rod 44 in a manner to be spaced from each other. In the disclosed embodiment, these spring holders 46 and 46' are located near the corresponding arms 42 and 42'. With this, it will be appreciated that the spring holders 46 and 46' and the upper rod 44 form a unit which is movable or swingable about the axis of the upper rod 44 relative to the arms 42 and 42'. Alternately curved three springs 48*a*, 48*b* and 48*c* are spanned between the spring holders 46 and 46' in parallel manner with their ends being hooked on the corresponding hook portions of the spring holders 46 and 46'. To avoid metal contact between the ends of the springs 48*a*, 48*b* and 48*c* and the hook portions of the spring holders 46 and 46', a spacer 49 made of plastics is disposed within each hook portion as is seen from FIG. 6. As is well understood from FIGS. 3 and 5, the front edge of each spring holder 46 and 46' is convexly curved so that one of the springs 48*a*, 48*b* and 48*c* is most projected forwardly when the unit of the spring holders 46 and 46' and the springs assumes a predetermined angular position with respect to the arms 42 and 42'.

Description will be now directed to a fore-and-aft controlling mechanism which shifts the unit of the spring holders 46 and 46' and springs 48*a*, 48*b* and 48*c* in the fore-and-aft directions.

Figure 4:
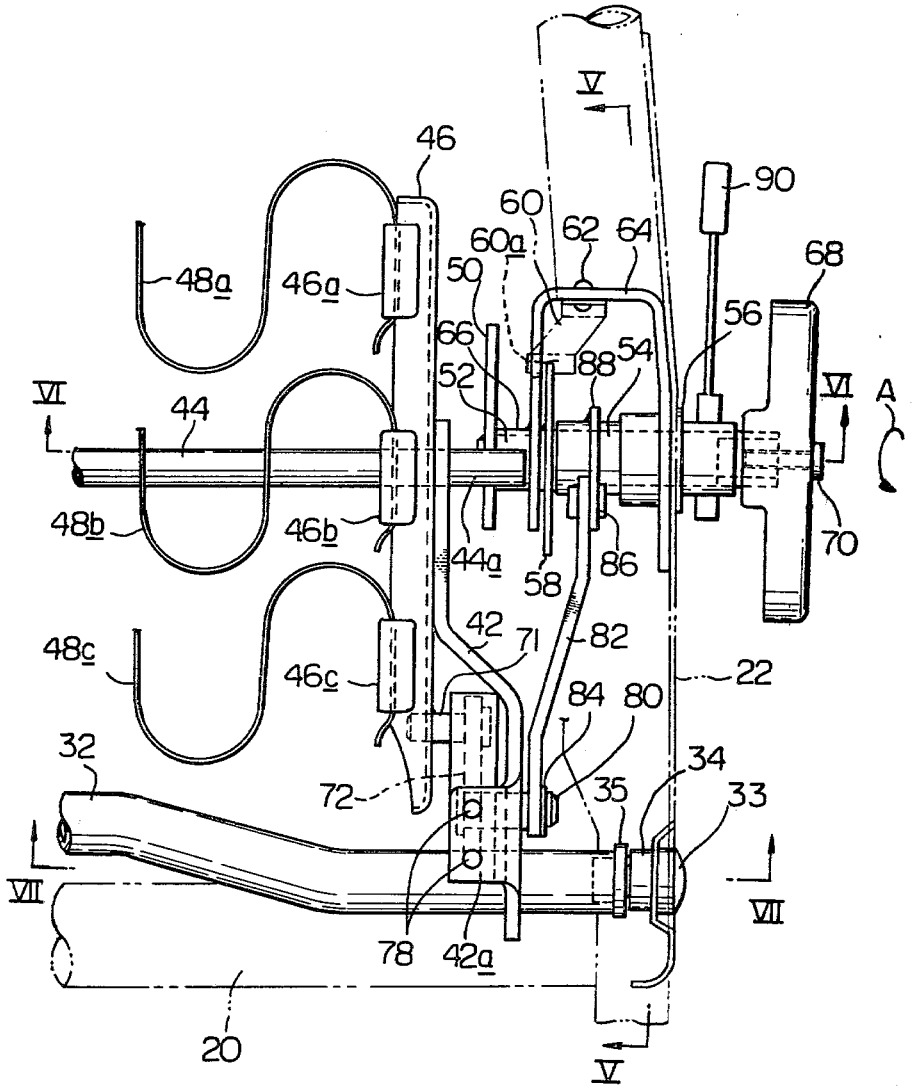
FIG. 4 is an enlarged view of a part enclosed by a line IV of FIG. 2.
Figure 5:
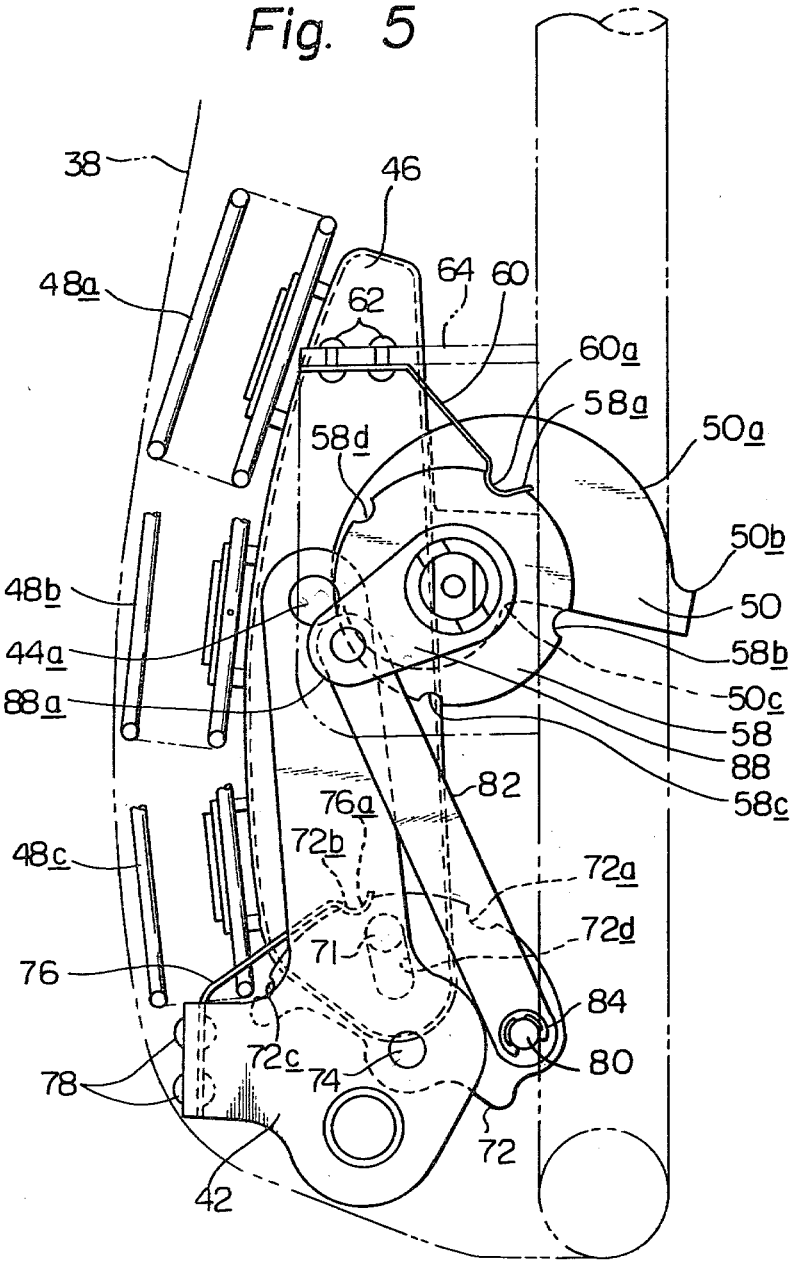
FIG. 5 is a sectional view taken along the line V—V of FIG. 4.
Figure 6:
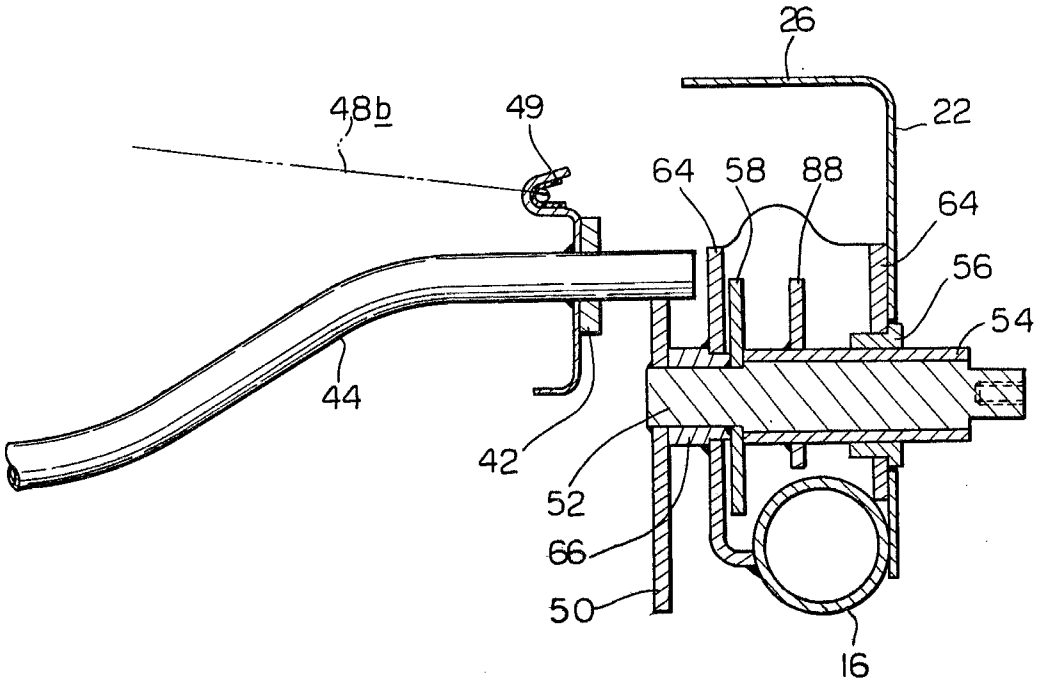
FIG. 6 is a partially sectional view taken along the line VI—VI of FIG. 4.

As is well shown in FIGS. 4 and 5, the fore-and-aft controlling mechanism comprises a snail cam 50 which has a cam periphery 50*a* operatively contacting an extension 44*a* of the upper rod 44. The snail cam 50 is fixed to a cylindrical rod 52 to be rotatable therewith about the axis of the rod 52. As is apparent from FIG. 6, the cylindrical rod 52 is coaxially and rotatably received in a sleeve 54 which in turn is coaxially and rotatably held in a bush 56. The bush 56 is firmly coupled to an opening (no numeral) formed in the side bracket 22. (As will become clear hereinafter, the sleeve 54 is a part of a height controlling mechanism.) Coaxially and firmly mounted on the cylindrical rod 52 is a circular stopper plate 58 which has at the periphery thereof a plurality of recesses 58*a*, 58*b*, 58*c* and 58*d*. The periphery of the stopper plate 58 is in contact with a free bent end 60*a* of a leaf spring 60 fixed via rivets 62 to a generally U-shaped bracket 64 which is secured to the tubular frame 16. As is best seen from FIG. 6, the bracket 64 is arranged to support not only the bush 56 but also an inboard end section of the cylindrical rod 52 via a sleeve 66. The free bent end 60*a* of the leaf spring 60 is biased toward the periphery of the stopper plate 58, so that the rotation of the stopper plate 58 is made stepwisely because of the selective engagement of the free end 60*a* of the spring 60 with one of the recesses 58*a*, 58*b*, 58*c* and 58*d* of the stopper plate 58. A knob 68 is fixed via a bolt 70 to an outboard end of the cylindrical rod 52 as is shown in FIG. 4.

Next description is directed to a height controlling mechanism which causes swinging movement of the unit of the spring holders 46 and 46' and the springs 48*a*, 48*b* and 48*c* about the upper rod 44.

As is best seen from FIG. 4, the height controlling mechanism comprises a stud 71 which is secured to the spring holder 46 to project rightward in the drawing. The stud 71 is spacedly received in an elongate slot 72*d* formed in a cam plate 72 which is formed at the periphery thereof with a plurality of recesses 72*a*, 72*b* and 72*c* (see FIG. 5). The cam plate 72 is pivotally supported via a pin 74 on a lower section of the arm 42. The periphery of the cam plate 72 is in contact with a free bent end 76*a* of a leaf spring 76 which is fixed via rivets 78 to a lug section 42*a* of the arm 42. Similarly to the case of the afore-mentioned leaf spring 60, the free end 76*a* of the spring 76 is biased toward the periphery of the cam plate 72. As is best seen from FIG. 5, the cam plate 72 is equipped at an end section thereof with a pivot pin 80 from which a link 82 extends upwardly toward the afore-mentioned sleeve 54. Denoted by numeral 84 is an E-ring for pivotal connection between the link 82 and the pin 80. The link 82 is pivotally connected via a pivot pin 86 at its upper end to a free end 88*a* of a link lever 88 which is firmly mounted on the sleeve 54. A handle lever 90 is secured to an outboard end section of the sleeve 54.

Operation of the adjustable lumbar supporter 40 will be described with reference to FIGS. 4 and 5, but for facilitation of the description, it will commence with respect to such a state of the lumbar supporter 40 as shown in FIG. 5 wherein the leaf spring 60 engages with the recess 58*a* of the stopper plate 58 and the leaf spring 76 engages with the recess 72*b* of the cam plate 72, causing the lumbar holding section to assume the illustrated position.

First, the operation achieved by the fore-and-aft controlling mechanism will explained.

When the knob 68 is rotated by a given degree in the direction of "A" (see FIG. 4), that is a counterclockwise direction in FIG. 5, the snail cam 50 and the stopper plate 58, which are united via the cylindrical rod 52 to the knob 68, rotate in the same direction releasing the free bent end 60*a* of the leaf spring 60 from the recess 58*a* of the stopper plate 58 and finally causing the free bent end 60*a* to drop into the next-positioned recess 58*b*. During this movement, the periphery of the snail cam 50 slides on the extension 44*a* of upper rod 44 pushing the same forwardly thereby causing the unit of the spring holders 46 and 46' with the springs 48*a*, 48*b* and 48*c* to swing forwardly by a certain degree about the axis of the lower rod 32. Thus, the padding 38 covering the lumbar holding section moves forwardly. With this explanation, it will be appreciated that further rotation of the knob 68 in the same direction induces further forward movement of the padding 38, and rotation of the knob 68 in the reverse direction induces flattening of the padding 38. The forward or rearward movement of the padding 38 is limited by engaging a stopper end 50*b* or 50*c* (see FIG. 5) formed on the snail cam 50 with the upper rod 44.

The next description is directed to the operation achieved by the height controlling mechanism.

When the handle lever 90 is rotated by a given degree in the direction of "A" (see FIG. 4) that is in the counterclockwise direction in FIG. 5, the link lever 88 united via the sleeve 54 to the handle lever 90 rotates in the same direction pushing down the link 82 thereby rotating the cam plate 72 about the pin 74 in the clockwise direction (in FIG. 5) with a result that the free bent end 76*a* of the leaf spring 76 drops into the recess 72*c* of the cam plate 72. With this clockwise rotation of the cam plate 72, the stud 71 received in the elongate slot 72*d* of the cam plate 72 is forced to move in the rightward direction (in FIG. 5) swinging the unit of the spring holders 46 and 46' with the springs 48*a*, 48*b* and 48*c* about the axis of the upper rod 44 in a counterclockwise direction (in FIG. 5), that is the direction to permit the uppermost-positioned spring 48*a* to be most projected forwardly thus strongly pressing a predetermined upper portion of the padding 38. When the handle lever 90 is rotated in the reverse direction to such an extent that the free bent end 76*a* of the leaf spring 76 drops into the recess 72*a* of the cam plate 72, the unit of the spring holders 46 and 46' with the springs 48*a*, 48*b* and 48*c* is swung about the axis of the upper rod 44 in a clockwise direction (in FIG. 5) assuming a position to permit the lowermost-positioned spring 48*c* to be most projected forwardly thus strongly pressing a predetermined lower portion of the padding 38. With this, it will be appreciated that a forwardly projected part of the padding 38 which contributes substantially to lumbar supporting moves upwardly or downwardly upon handling the lever 90.

The following are advantageous features provided by the invention:

(1) The lumbar supporting section can move in both fore-and-aft direction and upward-and-downward directions.

(2) The movements of the lumbar supporting section are controlled by the knob 68 and the lever 90 which are positioned near each other.

(3) The moving manner of the lumbar supporting section is similar to the manners of the knob 68 and the lever 90. (The rotation of the knob 68 in the direction of "A" moves the lumbar supporting section forwardly, and the rotation of the lever 90 in the direction of "A" induces swing of the lumbar supporting section in the same direction.)

With these features, the most desired and effective positioning of the lumbar supporting section for properly supporting the seated occupant's lumbar area is easily made irrespective of differences in individual body sizes and proportions.

It should be noted that the foregoing description shows only one exemplary embodiment. Various modifications are apparent to those skilled in the art without departing from the scope of the present invention which is only limited by the appended claims.

What is claimed is:

1. A seat with a backrest having spaced support portions by which a contourable portion constituted by padding means is supported, and an adjustable lumbar supporter for imparting a curvature to said contourable portion to produce a desired contour, said lumbar supporter comprising:

a first rod member transversely crossing said support portions in a manner so as to be rotatable about the axis thereof relative to said support portions;

an arm member secured at its one portion to said first rod member to be rotatable therewith;

a second rod member held by said arm member in a manner so as to be rotatable about the axis thereof relative to said arm member;

lumbar pressing means fixedly mounted on said second rod member;

a first control mechanism for forcing a unit of said arm member, said second rod member and said lumbar pressing means to swing about the axis of said first rod member when operated; and a second control mechanism for forcing a unit of said lumbar pressing means and said second rod member to swing the axis of said second rod member relative to said arm member when operated;

said first control mechanism comprising;

a first cam having a cam periphery operatively contacting said second rod member;

a first axle member connected to said first cam to be rotatable therewith about the axis of said first axle member; and first stopping means for causing said axle member to assume a predetermined rest position under rotation thereof;

said second control mechanism comprising:

a second cam supported via a pivot by said arm member and having therein an elongated slot;

a stud secured to said lumbar pressing means and movably received in said elongated slot of said second cam;

second stopping means for causing said second cam to assure a predetermined rest position under the swingable rotation of it about said pivot;

a second axle member; and a linkage operatively interposed between said second axle member and said second cam in such a manner that when said second axle member is rotated about the axis thereof, said second cam is swung about said pivot.

2. A seat as claimed in claim 1, in which said second axle member of said second control mechanism is a sleeve through which said first axle member of said first control mechanism passes.

3. A seat as claimed in claim 1, in which said first cam is a snail cam.

4. A seat as claimed in claim 1, in which said first stopping means comprises:

a circular plate concentrically and securely mounted on said first axle member and having at the periphery thereof a plurality of recesses; and a spring member having one end secured to a stationary member and the other end urgingly pressed on the periphery of said circular plate.

5. A seat as claimed in claim 1, in which said second stopping means comprises:

a plurality of recesses formed in the periphery of said second cam; and a spring member having one end secured to said arm member and the other end urgingly pressed on the periphery of said second cam.

6. A seat as claimed in claim 1, in which said linkage comprises:

a pin secured at its one end to said second cam;

a link pivotally connected at its one end to the other end of said pin;

a link lever having one end securely mounted on said second axle member and the other pivotally connected to the other end of said link.

7. A seat as claimed in claim 2, in which a unit of said first and second axle member is supported by one of said frame members via a bush.

8. A seat as claimed in claim 1, in which said lumbar pressing means comprises:

two holders firmly mounted on said second rod member to be spaced from each other; and a plurality of springs spanned between said two holders.

* * * * *